US005957270A

United States Patent [19]

Ahn

[11] Patent Number: 5,957,270

[45] Date of Patent: Sep. 28, 1999

[54] SWITCH ASSEMBLY HAVING PUSH BUTTON, AND ELECTRONIC APPARATUS INCLUDING IT

[75] Inventor: Hae-Won Ahn, Kyungki-do, Rep. of Korea

[73] Assignee: SamSung Electronics Co., Ltd., Kyungki-do, Rep. of Korea

[21] Appl. No.: 09/106,744

[22] Filed: Jun. 30, 1998

[30] Foreign Application Priority Data

Jun. 30, 1997 [KR] Rep. of Korea ..... 97-16934 U

[51] Int. Cl.[6] ..... H01H 3/20

[52] U.S. Cl. ..... 200/331; 200/330; 200/341; 74/503

[58] Field of Search ..... 74/503; 200/329–331, 200/337, 341, 520, 537, 538, 292, 311, 313, 314, 17 R

[56] References Cited

U.S. PATENT DOCUMENTS

| | | | |
|---|---|---|---|
| 4,011,423 | 3/1977 | Zepp | 200/330 |
| 4,051,340 | 9/1977 | Wolski | 200/329 |
| 4,454,397 | 6/1984 | Kim | 200/296 |
| 4,954,668 | 9/1990 | Sako | 200/314 |
| 5,193,667 | 3/1993 | Choi | 200/331 |
| 5,577,601 | 11/1996 | Chung et al. | 200/331 |

*Primary Examiner*—Michael A. Friedhofer
*Attorney, Agent, or Firm*—Robert E. Bushnell, Esq.

[57] ABSTRACT

A switch assembly activates an electronic apparatus in such a manner that, despite unavoidable gaps existing between different components of the switch assembly, force is effectively transmitted from a push button to an activating switch. Between the push button and a transmitting member, a plunger and a socket together with a spring are disposed, and ratchets are formed on the plunger and the socket. Thus, the gaps between the different components of the switch assembly are eliminated. The ratchets are buttless threads which transmit the force from the push button to the transmitting member. The plunger is provided with a protrusion for coupling with a slot of the socket.

29 Claims, 6 Drawing Sheets

SWITCH ASSEMBLY HAVING PUSH BUTTON, AND ELECTRONIC APPARATUS INCLUDING IT

CLAIM OF PRIORITY

This application makes reference to, incorporates the same herein, and claims all benefits accruing under 35 U.S.C. §119 from an application for SWITCH ASSEMBLY HAVING PUSH BUTTON, AND ELECTRONIC APPARATUS INCLUDING IT earlier filed in the Korean Industrial Property Office on the $30^{th}$ of June 1997 and there duly assigned Ser. No. 16934/1997.

BACKGROUND OF THE INVENTION

1. Technical Field

The present invention relates to a switch assembly for activating an electronic apparatus, and to an electronic apparatus including the switch assembly. More specifically, the present invention relates to a switch assembly for activating an electronic apparatus, and to an electronic apparatus including the switch assembly, in which the clearances formed between different parts of the switch assembly are eliminated so that malfunctions can be prevented.

2. Related Art

Generally, in electronic apparatuses such as monitors, televisions and the like, switches are installed so as to control various functions such as volume, picture quality and the like. These switches are exposed to the outside, and if these switches are manipulated, the manipulation is transmitted to internal switches, such as a tack switch and the like.

However, in such electronic apparatuses, a problem arises in that components, such as a push button, a tack switch, and a transmitting member interconnecting the bush button and the tack switch have machining tolerance as well as assembly tolerances. As a result, pressing of the push button does not produce an immediate response; that is, there is a time delay between pressing of the push button and occurrence of the desired function.

The latter problem is complicated by other tolerances present in such electronic apparatuses. Such additional tolerances include those associated with an insertion hole formed in a circuit board for receiving a leg of the tack switch, as well as tolerances due to the inclination of the leg. Moreover, variation in the length of the transmitting member due to temperature and other actuation and coupling tolerances further exacerbate the aforementioned problem.

Therefore, there is a need for the development of an arrangement or mechanism which is capable of activating the switch, regardless of the aforementioned tolerance gaps.

SUMMARY OF THE INVENTION

The present invention is intended to overcome the above described disadvantages.

Therefore, it is an object of the present invention to provide a switch assembly in which the push button is effective for activating a tack switch or the like, even in the presence of gaps (which are unavoidably formed).

It is another object of the present invention to provide a switch assembly which is easily assembled during the manufacturing process, and which, at the same time, has a push button which is effective in activating a tack switch or the like.

It is still another object of the present invention to provide an electronic apparatus having a switch assembly, in which the push button is effective for activating a tack switch or the like, even in the presence of unavoidable gaps.

Further objects of the present invention will become apparent in the detailed description presented below.

In achieving the above objects, the switch assembly according to the present invention includes: a housing; a push button secured on the housing so as to move a predetermined distance in a longitudinal direction, and having a stem extending in the longitudinal direction; an activating switch disposed so as to be separated by a certain distance from the push button; first elastic means disposed between the housing and the push button for restoring the push button after releasing it; a transmitting member for transmitting a force from the push button to the activating switch; and an interlocking means for interlocking the stem of the push button with the transmitting member.

Preferably, the interlocking means includes: a socket; a plunger accommodated within the socket; second elastic means for providing an expanding force between the socket and the plunger; and ratchet means for restricting the movement of the plunger in the direction of insertion into the socket, but allowing movement in the opposite direction. The expanding force of the second elastic means is limited to a certain range, and therefore, if the push button is not pushed, the activating switch is not actuated. The plunger and the socket are coupled either to the transmitting member or to the stem of the push button, or are integrally formed with it. Which one of the plunger and the socket is coupled to which one of the transmitting member and the push button is not critical to the invention, which encompasses any of those arrangements.

The ratchet means may be any suitable type which allows movement in one direction, but does not allow movement in the other direction. Preferably, however, the ratchet means should consist of buttless threads which are formed on the inside of the socket and on the outside of the plunger.

Preferably, the plunger is cylindrical, and has a protrusion which projects in the radial direction. The socket has a slot which receives the protrusion of the plunger. Thus the plunger can be secured into the socket. However, alternatively, the radially projecting protrusion is provided on the socket, while the slot is provided in the plunger.

The slot of the socket comprises: a first longitudinal slot segment extending in the longitudinal direction from one end of the socket; a circumferential slot segment extending from an end of the first longitudinal slot in the angular direction by a certain angle; and a second longitudinal slot segment extending from an end of the circumferential slot segment in the longitudinal direction but stopping at a shorter distance compared with the first longitudinal slot segment. When the protrusion stays within the first longitudinal slot segment, the two sets of threads are meshed together. However, any other structure for securing the plunger into the socket may be adopted. The outside diameter of the plunger should be smaller than the inside diameter of the socket so that the plunger can be easily inserted into the socket.

The first elastic means may be any structure having an elastic force to restore the push button. Preferably, however, it should be a spring. The second elastic means may be an elastomeric material such as rubber, but preferably it is a compression spring.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

The present invention will be described referring to the attached drawings, and the same elements will be assigned with the same reference codes throughout the drawings.

Figure 1:
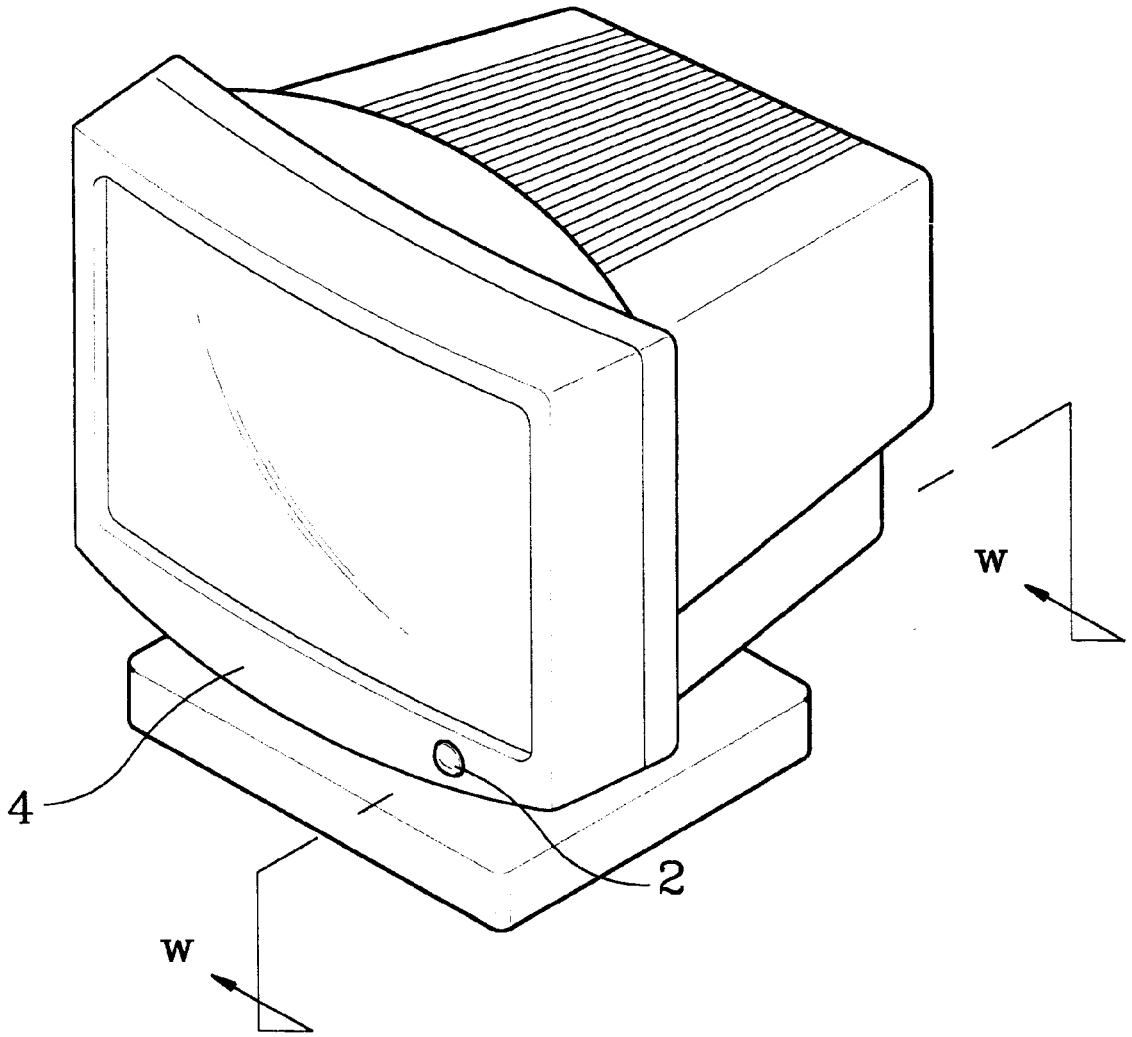
FIG. 1 is a perspective view of a monitor with a switch assembly installed thereon.
Figure 2A:
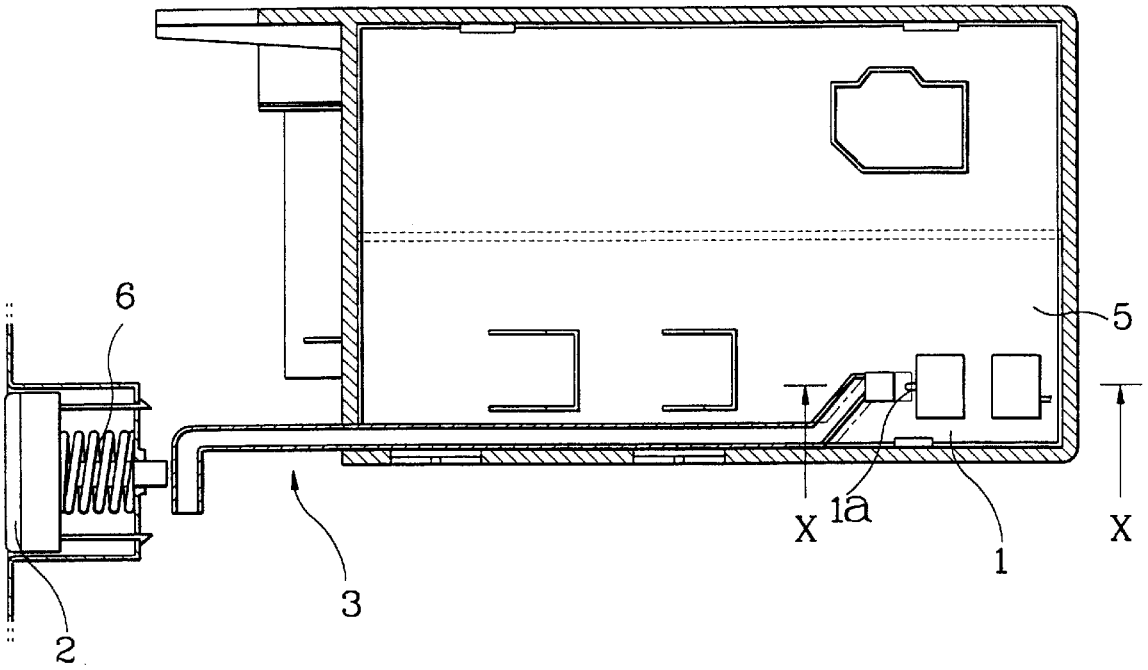
FIG. 2 is a sectional view taken along a line W—W of FIG. 1, schematically showing the constitution of the switch assembly.
Figure 2B:
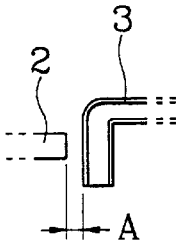
Figure 2C:
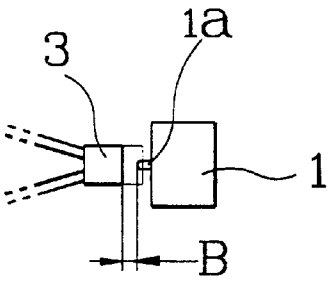

FIG. 1 illustrates a monitor as an example of an electronic apparatus. As shown in this drawing, the switch comprises a push button 2 which is disposed at a lower comer of the front face of the electronic apparatus. As shown in FIG. 2, if the push button 2 is pressed, the force is transmitted to an operating segment 1*a* of a tack switch 1. The push button 2 is installed on a front case 4 by using a compression spring 6, so that the push button can have a restoring function. One end of a transmitting member 3 is disposed near the operating segment 1*a* of the tack switch 1, while another end of transmitting member 3 is disposed near one end of a stem of the push button 2. The ends of the transmitting member 3 are bent in opposite directions as shown in the drawing. The bent portions of member 3 are disposed near the push button 2 and the operating segment 1*a*, respectively, and therefore, if force is applied to the push button 2, the other end of the transmitting member 3 presses the operating segment 1*a* of the tack switch 1 so that the monitor can be turned on or off.

However, components such as the push button 2, the transmitting member 3 and the tack switch 1 have machining tolerances and assembly tolerances. Therefore, when the push button 2 is pressed, the operating segment 1*a* does not respond immediately.

It will be assumed that the gap between the push button 2 and the transmitting member 3 is A, as shown in FIG. 2, and that the gap between the transmitting member 3 and the operating segment 1*a* of the tack switch is B, as also shown in FIG. 2. Thus, the operating segment 1*a* will be actuated after elapse of a time proportional to A+B.

Figure 3:
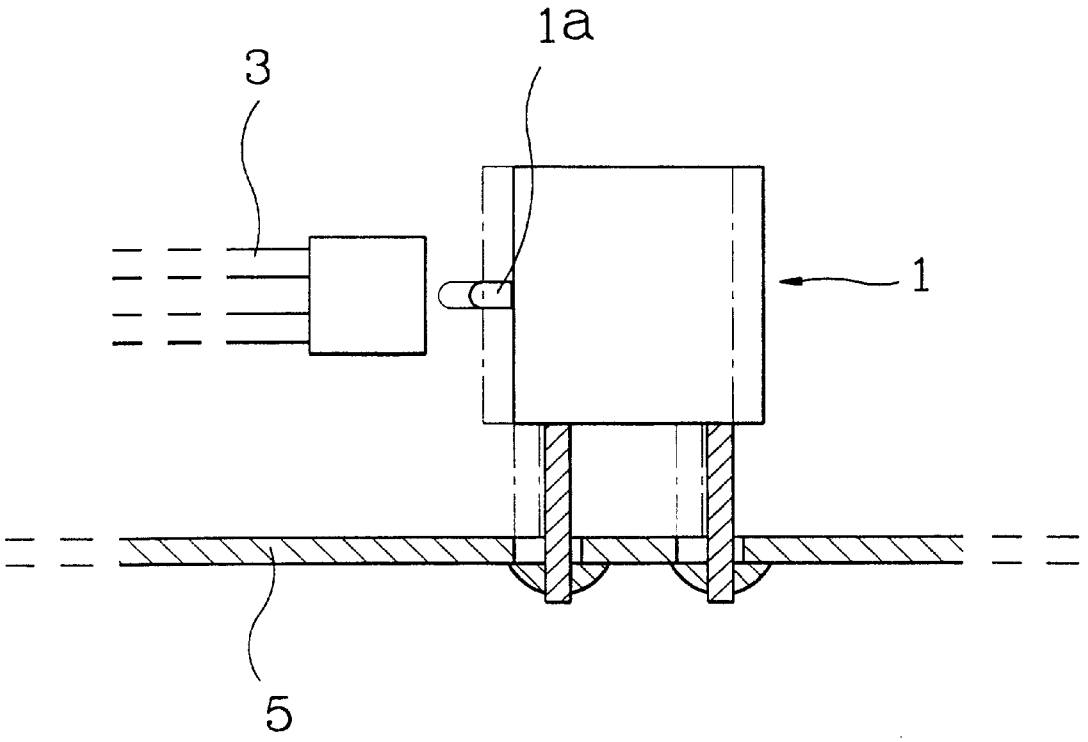
FIG. 3 is a sectional view taken along a line X—X of FIG. 2.

Generally, an insertion hole 5*a* (FIG. 3) formed in a circuit board 5 for receiving a leg 1*b* of the tack switch 1 has a tolerance of ±0.2 mm. When the leg 1*b* of the tack switch 1 is inserted into the insertion hole 5*a* of the circuit board 5, the tolerance due to the inclination of the leg is ±0.2 mm. The tolerance which occurs during the fixing of the circuit board 5 to a bracket (not shown) of the case 4 is ±0.5 mm. The variation in the length of the transmitting member 3 due to variation in temperature is ±1.0 mm. The actuation tolerance of the operating segment 1*a* of the tack switch 1 is ±0.2 mm. The tolerance for the moving distance of the operating segment 1*a* of the tack switch 1 is ±0.2 mm. The coupling tolerance between the case 4 and the bracket is ±0.3 mm. Thus, the sum total of the latter tolerances amounts to ±2.6 mm at the maximum.

Meanwhile, the push button 2 is generally designed to have a moving distance of about 10.5 mm. However, about 3 mm has to be excluded because of the presence of the compression spring 6 and, therefore, the actual moving distance of the push button 2 is about 7.5 mm. In order to make the push button actuate in a perfect manner, a clearance of about 1.5 mm between the push button 2 and the transmitting member 3 is provided, while a clearance of 1.0 mm between the transmitting member 3 and the operating segment 1*a* of the tack switch 1 is provided.

Therefore, if the push button 2 is to be effectively actuated, the push button 2 has to be pressed some distance plus the clearance of 1.5 mm and the clearance of 1.0 mm. Then, the transmitting member 3 will push the operating segment 1*a*. The operating segment 1*a* of the tack switch 1 is effectively actuated only after being moved by 2.5 mm. Therefore, the transmitting member 3 will probably have to be moved by about 2.5 mm more (5.0 mm less the required moving distance 2.5 mm of the operating segment 1*a* of the tack switch 1) together with the push button 2.

That is, if a maximum gap is formed within the total tolerance of ±2.6 mm, then the push button 2 can move only by 2.5 mm. Therefore, in that case, the tack switch 1 cannot be activated. On the other hand, if a minimum gap is formed within the total tolerance of ±2.6 mm, even if force is applied to the push button 2, the push button 2 and the transmitting member 3 cannot move at all, with the result that the tack switch 1 cannot be activated.

Thus, the tack switch (power switch) cannot be activated under the maximum and minimum tolerances. Therefore, there is a need for some arrangement or mechanism which is capable of activating the tack switch, regardless of the tolerance gaps.

Figure 4:
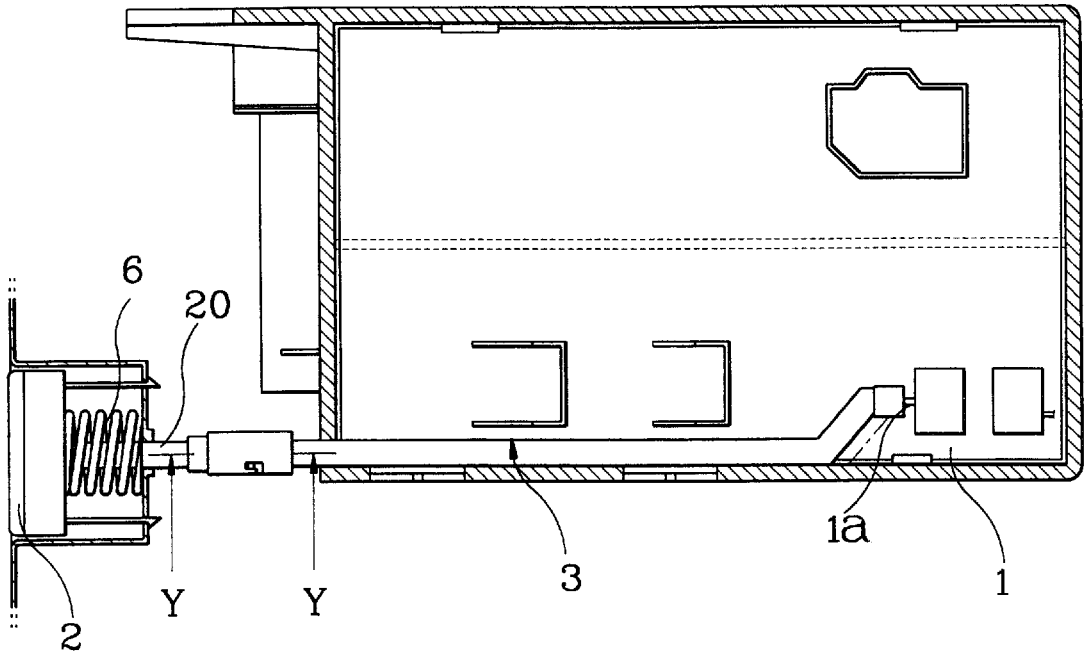
FIG. 4 is a sectional view taken along a line W—W of FIG. 1, showing an embodiment of the switch assembly according to the present invention.

In FIG. 4, a push button 2 is exposed to the outside as in FIG. 1. If the push button 2 is pressed, a transmitting member 3 transmits the force to a tack switch 1 which is disposed at the rear of the electronic apparatus. A compression spring 6 is installed between the push button 2 and its housing 2*a*, so that the push button 2 is restored when the pushing force is released. As can be seen in FIG. 4, one end of the transmitting member 3 is connected through a socket 18 and a plunger 7 to the push button 2, while another end of the transmitting member 3 contacts operating segment 1*a* of the tack switch 1.

Figure 5:
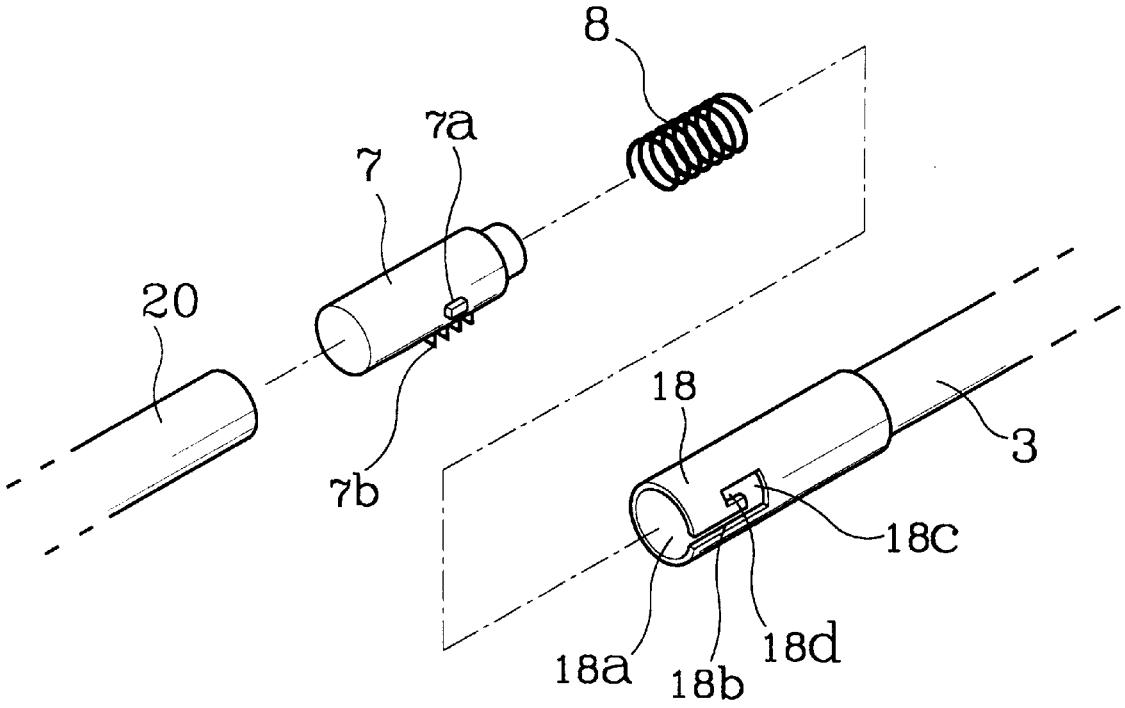
FIG. 5 is an exploded perspective view showing the constitution of the switch assembly according to the present invention.

The relationship of the socket 18 to the plunger 7 is illustrated in FIG. 5. In the preferred embodiment of the present invention, the plunger 7 is cylindrical, and is provided with a protrusion 7*a* and buttless threads 7*b*. The plunger 7 is inserted into the socket 18, with the protrusion 7*a* coupled into a slot 18*b*.

A spring 8 is first inserted into socket 18, and then the plunger 7 is inserted.

Now the assembly procedure for the plunger 7 and the socket 18 will be described.

First, the plunger 7 contacts a stem 20 of the push button 2, or the plunger 7 is fixed to the stem 20 by use of adhesive or the like. The compression spring 8 is inserted into the opening 18*a* in socket 18, and the plunger 7 is then moved into the socket 18 so that the protrusion 7*a* is inserted into the slot 18*b*. The plunger 7 is then rotated so that the protrusion 7*a* moves along the circumferential segment 18*c*. Then, the applied force is released, so that the protuberance 7*a* move back along the shorter longitudinal segment 18*d* owing to the elastic force of the spring 8. Under this condition, the buttless threads 3*c* (FIG. 6) of the socket 18 and the buttless threads 7*b* of the plunger 7 are arranged such that relative movement between the plunger 7 and the socket 18 are not impeded. As a result of the relative movement, gaps between the different components of the switch assembly are eliminated. Under this condition, the compression spring 8 should not be too strong, so that the operating segment 1*a* of the tack switch 1 is not actuated merely by the force of the spring 8.

Figure 6:
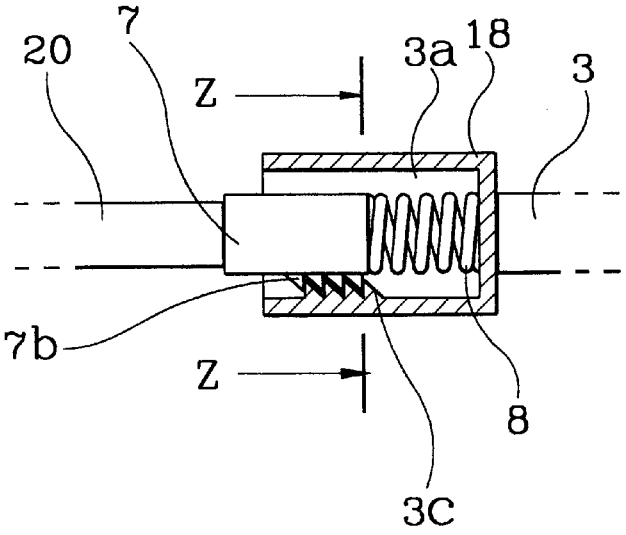
FIG. 6 is a sectional view taken along a line Y—Y of FIG. 4.
Figure 7:
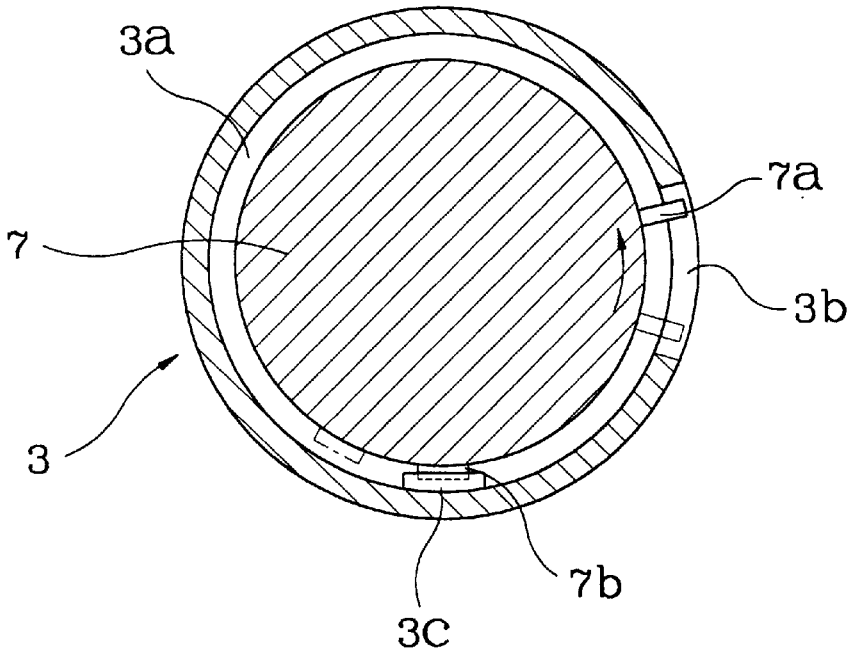
FIG. 7 is a sectional view taken along a line Z—Z of FIG. 6.

FIGS. 6 and 7 illustrate the relationship of the plunger 7 to the socket 18. As can be seen in FIG. 6, the spring 8 contacts one end of the plunger 7 within the socket 18. The buttless threads 7*b* and 3*c* are designed such that the plunger 7 cannot be further inserted into the socket 18. Therefore, if the push button 2 is pressed, then the force is transmitted through the stem 20, the plunger 7, the buttless threads 7*b* and 3*c*, the socket 18 and the transmitting member 3 to the operating segment 1 a of the tack switch 1. FIG. 7 is a sectional view showing the coupling between the plunger 7 and the socket 18. That is, in a state with the protrusion 7*a* rotated, the coupling with the buttless threads 3*c* is illustrated.

In the preferred embodiment of the present invention, the socket 18 and the transmitting member 3 are integrally formed together, while the push button 2 is provided separately from the plunger 7. However, alternatively, a structure of an opposite pattern may be provided. That is, the push button 2 and the plunger 7 may be integrally formed while the socket 18 and transmitting member 3 are separate from each other. Further, both pairs of the latter members can be integrally formed or separately formed.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A switch assembly comprising:

a housing;

push button means secured on said housing and actuable by a user for moving a certain distance in a longitudinal direction, and having a stem extending in a longitudinal direction;

an activating switch disposed adjacent to, and separated by a certain distance from, said push button means;

first elastic means disposed between said housing and said push button means for restoring said push button means when said push button means is released by the user;

transmitting member means for transmitting a force from said push button means to said activating switch to actuate said activating switch; and interlocking means for interlocking said stem of said push button means with said transmitting member means;

wherein said interlocking means comprises:

a socket;

a plunger accommodated within said socket;

second elastic means inserted into said socket for providing an expanding force between said socket and said plunger; and ratchet means for restricting movement of said plunger in a direction of insertion into said socket, and for allowing movement in an opposite direction, whereby the expanding force of said second elastic means is limited to a certain range, and whereby, if said push button means is not actuated by the user, said activating switch is not actuated.

2. The switch assembly as claimed in claim 1, wherein said socket is formed integrally with said transmitting member, and said plunger contacts said stem.

3. The switch assembly as claimed in claim 2, wherein said ratchet means comprises buttless threads formed on an interior of said socket and on an exterior of said plunger, respectively.

4. The switch assembly as claimed in claim 3, wherein said plunger is cylindrical and is provided with a radially projecting protrusion; and said socket is provided with a slot, said protrusion being insertable into said slot.

5. The switch assembly as claimed in claim 4, wherein said slot of said socket comprises:

a first longitudinal slot segment extending in a longitudinal direction from an open end of said socket to an end of said first longitudinal slot;

a circumferential slot segment extending from the end of said first longitudinal slot segment in a generally transverse direction of said slot to an end of said circumferential slot segment; and a second longitudinal slot segment extending from the end of said circumferential slot segment in a longitudinal direction toward the open end of said socket but stopping at a shorter distance compared with a length of said first longitudinal slot segment;

whereby, when said protrusion stays within said slot, said buttless threads are meshed together.

6. The switch assembly as claimed in claim 5, wherein said first elastic means comprises a compression spring.

7. The switch assembly as claimed in claim 5, wherein said second elastic means comprises a compression spring.

8. The switch assembly as claimed in claim 4, wherein said first elastic means comprises a compression spring.

9. The switch assembly as claimed in claim 4, wherein said second elastic means comprises a compression spring.

10. The switch assembly as claimed in claim 3, wherein said first elastic means comprises a compression spring.

11. The switch assembly as claimed in claim 3, wherein said second elastic means comprises a compression spring.

12. The switch assembly as claimed in claim 2, wherein said first elastic means comprises a compression spring.

13. The switch assembly as claimed in claim 2, wherein said second elastic means comprises a compression spring.

14. The switch assembly as claimed in claim 1, wherein said ratchet means comprises buttless threads formed on an interior of said socket and on an exterior of said plunger, respectively.

15. The switch assembly as claimed in claim 1, wherein said first elastic means comprises a compression spring.

16. The switch assembly as claimed in claim 1, wherein said second elastic means comprises a compression spring.

17. An electronic apparatus including a switch assembly comprising:

a housing;

push button means secured on said housing and actuated by a user for moving a certain distance in a longitudinal direction, and having a stem extending in a longitudinal direction;

an activating switch disposed adjacent to, and separated by a certain distance from, said push button means;

first elastic means disposed between said housing and said push button means for restoring said push button means when said push button means is released by the user;

transmitting member means for transmitting a force from said push button means to said activating switch to actuate said activating switch; and interlocking means for interlocking said stem of said push button means with said transmitting member means, said interlocking means comprising a socket, a plunger, and ratchet means for restricting movement of said plunger in a direction of insertion into said socket, and for allowing movement in an opposite direction.

18. The electronic apparatus as claimed in claim 17, wherein said interlocking means further comprises:

second elastic means inserted into said socket for providing an expanding force between said socket and said plunger, whereby the expanding force of said second elastic means is limited to a certain range and whereby, if said push button means is not actuated by the user, said activating switch is not actuated.

19. The electronic apparatus as claimed in claim 18, wherein said electronic apparatus comprises a monitor.

20. A switch assembly comprising:

a housing;

push button means secured on said housing and actuable by a user for moving a certain distance in a longitudinal direction, and having a stem extending in a longitudinal direction;

an activating switch disposed adjacent to, and separated by a certain distance from, said push button means;

transmitting member means for transmitting a force from said push button means to said activating switch to actuate said activating switch; and interlocking means for interlocking said stem of said push button means with said transmitting member means, said interlocking means comprising a socket, a plunger and ratchet means for restricting movement of said plunger in a direction of insertion into said socket, and for allowing movement in an opposite direction.

21. The switch assembly as claimed in claim 20, in wherein said interlocking means comprises:

elastic means inserted into said socket for providing an expanding force between said socket and said plunger, whereby the expanding force of said elastic means is limited to a certain range, whereby, if said push button means is not actuated by the user, said activating switch is not actuated.

22. The switch assembly as claimed in claim 21, wherein said socket is formed integrally with said transmitting member, and said plunger contacts said stem.

23. The switch assembly as claimed in claim 22, wherein said ratchet means comprises buttless threads formed on an interior of said socket and on an exterior of said plunger, respectively.

24. The switch assembly as claimed in claim 23, wherein said plunger is cylindrical and is provided with a radially projecting protrusion; and said socket is provided with a slot, said protrusion being insertable into said slot.

25. The switch assembly as claimed in claims 24, wherein said slot of said socket comprises:

a first longitudinal slot segment extending in a longitudinal direction from an open end of said socket to an end of said first longitudinal slot;

a circumferential slot segment extending from the end of said first longitudinal slot segment in a generally transverse direction of said slot to an end of said circumferential slot segment; and a second longitudinal slot segment extending from the end of said circumferential slot segment in a longitudinal direction toward the open end of said socket but stopping at a shorter distance compared with a length of said first longitudinal slot segment;

whereby, when said protrusion stays within said slot, said buttless threads are meshed together.

26. The switch assembly as claimed in claim 21, wherein said elastic means comprises a compression spring.

27. The switch assembly as claimed in claim 26, wherein said ratchet means comprises buttless threads formed on an interior of said socket and on an exterior of said plunger, respectively.

28. The switch assembly as claimed in claim 21, wherein said ratchet means comprises buttless threads formed on an interior of said socket and on an exterior of said plunger, respectively.

29. The switch assembly as claimed in claim 20, wherein said ratchet means comprises buttless threads formed on an interior of said socket and on an exterior of said plunger, respectively.

* * * * *